US008794379B2

(12) United States Patent
Bronnaz et al.

(10) Patent No.: US 8,794,379 B2
(45) Date of Patent: Aug. 5, 2014

(54) ASCENDER DEVICE ON A DOUBLE ROPE

(75) Inventors: Alexandre Bronnaz, Bassens (FR); Alain Maurice, Saint Hilaire du Touvet (FR); Paul Petzl, Barraux (FR)

(73) Assignee: Zedel, Crolles (FR)

( * ) Notice: Subject to any disclaimer, the term of this patent is extended or adjusted under 35 U.S.C. 154(b) by 1212 days.

(21) Appl. No.: 12/213,843

(22) Filed: Jun. 25, 2008

(65) Prior Publication Data

US 2009/0008188 A1 Jan. 8, 2009

(30) Foreign Application Priority Data

Jul. 3, 2007 (FR) ..... 07 04795

(51) Int. Cl.

| | |
|---|---|
| ***A62B 35/00*** | (2006.01) |
| ***A63B 29/02*** | (2006.01) |
| ***A62B 1/14*** | (2006.01) |

(52) U.S. Cl.

CPC .. *A63B 29/02* (2013.01); *A62B 1/14* (2013.01)
USPC ..... 182/5; 182/191; 188/65.3

(58) Field of Classification Search

USPC ..... 182/5, 11, 192, 193, 3, 6, 7, 10, 71, 182/135; 188/65.1–65.5
See application file for complete search history.

(56) References Cited

U.S. PATENT DOCUMENTS

| | | | | | |
|---|---|---|---|---|---|
| 290,007 | A | * | 12/1883 | Downing | 182/191 |
| 383,211 | A | * | 5/1888 | Calkins | 188/65.3 |
| 394,502 | A | * | 12/1888 | Nutting | 182/193 |
| 424,550 | A | * | 4/1890 | Hahn et al. | 182/5 |
| 457,285 | A | * | 8/1891 | Makely | 182/192 |
| 580,794 | A | * | 4/1897 | Money | 182/135 |
| 765,726 | A | * | 7/1904 | Crowe | 182/193 |
| 929,721 | A | * | 8/1909 | Sprankle | 182/193 |
| 969,559 | A | * | 9/1910 | O'Leary | 182/192 |
| 983,335 | A | * | 2/1911 | Westad | 182/135 |
| 1,035,176 | A | * | 8/1912 | Fine | 182/193 |
| 1,059,754 | A | * | 4/1913 | Paquet | 182/193 |
| 1,168,321 | A | * | 1/1916 | Maley | 182/135 |
| 1,179,886 | A | * | 4/1916 | Antoniella | 182/193 |
| 1,229,394 | A | * | 6/1917 | Abramson | 182/193 |
| 1,300,086 | A | * | 4/1919 | Wollin | 182/193 |
| 1,826,263 | A | * | 10/1931 | Stephens | 182/5 |
| 3,389,765 | A | * | 6/1968 | Pressley, Sr. | 188/65.5 |

(Continued)

FOREIGN PATENT DOCUMENTS

| | | |
|---|---|---|
| FR | 2 032 630 | 11/1970 |
| FR | 2 311 213 | 12/1976 |
| FR | 2 405 073 | 5/1979 |
| GB | 1 560 491 | 2/1980 |

OTHER PUBLICATIONS

I•den•ti•cal—adj. The American Heritage® Dictionary of the English Language, Fourth Edition copyright © 2000 by Houghton Mifflin Company. Updated in 2009. Published by Houghton Mifflin Company. All rights reserved.*

*Primary Examiner* — Daniel Cahn
(74) *Attorney, Agent, or Firm* — Oliff PLC

(57) ABSTRACT

An ascender device for a double rope is composed of two identical ascenders, the flanges of which are reversed by pivoting through 180° with respect to one another along a vertical axis extending parallel to the two troughs. The two grips are symmetrical with respect to the vertical axis so as to be able to be held at the same time by the user's right hand and left hand.

7 Claims, 6 Drawing Sheets

(56) References Cited

U.S. PATENT DOCUMENTS

| | | | | | |
|---|---|---|---|---|---|
| 3,437,178 | A | * | 4/1969 | Postlethwait | 188/65.2 |
| 3,658,151 | A | * | 4/1972 | Wisdom | 182/135 |
| 3,677,367 | A | * | 7/1972 | Shotmeyer | 182/136 |
| 3,682,276 | A | * | 8/1972 | Krauss | 188/65.3 |
| 3,889,777 | A | * | 6/1975 | George | 182/6 |
| 4,130,177 | A | * | 12/1978 | Pandolph | 182/8 |
| 4,667,772 | A | * | 5/1987 | Kammerer | 182/6 |
| 4,702,348 | A | * | 10/1987 | Lew et al. | 182/42 |
| 4,787,474 | A | * | 11/1988 | Brennan | 182/7 |
| 4,793,436 | A | * | 12/1988 | Lew et al. | 182/42 |
| 4,928,791 | A | * | 5/1990 | Hong | 182/135 |
| 5,029,669 | A | * | 7/1991 | Lew et al. | 182/42 |
| 5,156,240 | A | * | 10/1992 | Ostrobrod | 188/65.1 |
| 5,234,075 | A | * | 8/1993 | Lowden | 182/135 |
| 5,400,869 | A | * | 3/1995 | Rocourt | 182/133 |
| 5,845,894 | A | * | 12/1998 | Petzl et al. | 254/391 |
| 6,019,195 | A | * | 2/2000 | Pelofi | 182/192 |
| 6,079,518 | A | * | 6/2000 | Cho | 182/193 |
| 6,085,866 | A | * | 7/2000 | Kowalewski | 182/5 |
| 6,488,267 | B1 | * | 12/2002 | Goldberg et al. | 254/264 |
| D614,936 | S | * | 5/2010 | Petzl | D8/356 |
| 8,210,311 | B1 | * | 7/2012 | Rice | 182/9 |
| 8,459,411 | B2 | * | 6/2013 | Maurice et al. | 182/134 |
| 2002/0084139 | A1 | | 7/2002 | Richard et al. | |
| 2003/0196853 | A1 | * | 10/2003 | LeBeau et al. | 182/5 |
| 2006/0070809 | A1 | | 4/2006 | Barzilai | |
| 2006/0175132 | A1 | * | 8/2006 | Chun et al. | 182/192 |
| 2007/0007076 | A1 | * | 1/2007 | Chen et al. | 182/193 |
| 2007/0119652 | A1 | * | 5/2007 | Broyles | 182/5 |
| 2008/0164096 | A1 | * | 7/2008 | Rogelja | 182/5 |
| 2009/0188753 | A1 | * | 7/2009 | Liang | 182/133 |
| 2010/0181142 | A1 | * | 7/2010 | Gerner et al. | 182/5 |
| 2010/0200333 | A1 | * | 8/2010 | Maurice et al. | 182/133 |
| 2011/0186382 | A1 | * | 8/2011 | Sudale et al. | 182/3 |
| 2011/0232994 | A1 | * | 9/2011 | Broyles | 182/3 |
| 2011/0232995 | A1 | * | 9/2011 | Rogelja | 182/5 |

* cited by examiner

ASCENDER DEVICE ON A DOUBLE ROPE

BACKGROUND OF THE INVENTION

The invention relates to an ascender device for ascending on a double rope composed of a first ascender and a second ascender assembled to one another by securing means, each ascender comprising:

- a metal flange in the bottom part of which an aperture is cut out forming a grip on the outside,
- a trough arranged at the top part of the flange for passage of the rope,
- and a swivel cleat provided with a surface for jamming the rope in the bottom of said trough.

STATE OF THE ART

Ascenders for a double rope generally comprise a first ascender with a grip for the right hand and a second ascender with a grip for the left hand, which are mounted back to back without any offset so as to superpose the two grips. The two troughs are arranged side by side with the corresponding jamming cleats and final assembly of the apparatus is performed by riveting the two grips.

In another known apparatus, the grips are separated from one another without being superposed to enable a better grip with both hands. The two troughs do however remain arranged side by side as in the above-mentioned case.

In all known apparatuses, the two ascenders have flanges of different structures, which require several types of tooling for cutting and folding the right-hand and left-hand flanges of the two ascenders.

OBJECTIVE OF THE INVENTION

The object of the invention consists in providing an ascender device that is easy to use and to hold when ascending along a double rope, and that is manufactured with standard parts requiring the same tooling for manufacture of both the ascenders.

The device according to the invention is characterized in that the flanges of the two ascenders are identical and are reversed by pivoting through 180° with respect to one another along a vertical axis extending parallel to the two troughs, and that the two grips are symmetrical with respect to the vertical axis so as to be able to be held simultaneously by the user's right hand and left hand.

This results in a balanced bearing of the ascender device for double rope. The two flanges of identical structure are both manufactured with the same tooling in the case of a cutting and folding operation, or the same mould in the case of manufacture in a foundry.

The two flanges are superposed at the base and comprise a pair of coaxial holes forming a single securing hole for passage of a carabiner.

According to a first embodiment, the grips of the flanges are joined on the inside to two superposed branches extending vertically in the extension of the troughs and comprising coaxial holes for passage of the securing means.

According to a second embodiment, the ascenders are assembled in a heart shape, without superposed branches on the inside.

The identical flanges of the ascender device can be achieved by cutting and folding, by machining a metal sheet section, or by founding.

BRIEF DESCRIPTION OF THE DRAWINGS

Other advantages and features will become more clearly apparent from the following description of embodiments of the invention given as non-restrictive examples only and represented in the accompanying drawings, in which.

DESCRIPTION OF A PREFERRED EMBODIMENT OF THE INVENTION

In FIGS. 1 to 4, an ascender device 10 for ascending on a double rope C1, C2 is composed of a first ascender 11A and a second ascender 11B assembled to one another by securing means 12 so as to be able to be held at the same time by the user's right hand and left hand.

The two ascenders 11A, 11B present identical structures and are both achieved by means of the same cutting and folding tooling.

Each ascender 11A, 11B comprises a metal flange 13A, 13B made in particular of aluminium alloy, an internal aperture 14A, 14B designed to form a grip 15A, 15B on the outside being cut out in the bottom part of the flange.

The top part of each ascender 11A, 11B is folded into a U-shape to form a vertical trough 16A, 16B accommodating rope C1, C2, and further comprises a cleat 17A, 17B articulated on a transverse articulation axis 18A, 18B. Each cleat 17A, 17B is provided with a jamming surface in the form of a cam, equipped with a plurality of spurs of the type described in the document FR 2311213. A torsion spring 22A, 22B is mounted coaxially on axis 18A, 18B, and urges cleat 17A, 17B to press on rope C1, C2 inside corresponding trough 16A, 16B.

Opposite grip 15A, 15B, each aperture 14A, 14B of flange 13A, 13B is bounded by a substantially straight branch 19A, 19B extending vertically in the extension under corresponding trough 16A, 16B.

The base of each branch 19A, 19B of flanges 13A, 13B is provided with a circular opening 20A, 20B for passage of a carabiner. The intermediate part of branches 19A, 19B further comprises holes 21 with smaller diameters than those of openings 20A, 20B. Holes 21 will be used for fitting securing means 12.

Assembly of the two ascenders 11A, 11B is performed as follows:

Flanges 13A, 13B of the two ascenders 11A, 11B are identical and are reversed with respect to one another following a vertical pivoting movement through 180°, being adjoined via their internal branches 19A, 19B and troughs 16A, 16B. Straight branches 19A, 19B are thereby superposed, and openings 20A, 20B are coaxial and aligned in the transverse direction.

Holes 21 in branches 19A, 19B are also aligned enabling passage of securing means 12 formed by rivets or any other assembly system. Two rivets in superposed branches 19A, 19B are sufficient to obtain the required mechanical strength of ascender device 10.

Assembly of the two ascenders 11A, 11B is performed along vertical axis XY (FIGS. 2 and 3) extending parallel to the two troughs 16A, 16B and to the two straight branches 19A, 19B adjoined back to back by securing means 12. This vertical axis XY also constitutes the axis of symmetry of the two ascenders 11A, 11B.

When ascending along a double rope C1, C2, the user first attaches ascender device 10 to the harness by means of a carabiner (not represented) passing through openings 20A, 20B. He then passes double rope C1, C2 in troughs 16A, 16B, then climbs up along rope C1, C2 holding the two grips 15A, 15B with his right hand and his left hand.

Figure 1:
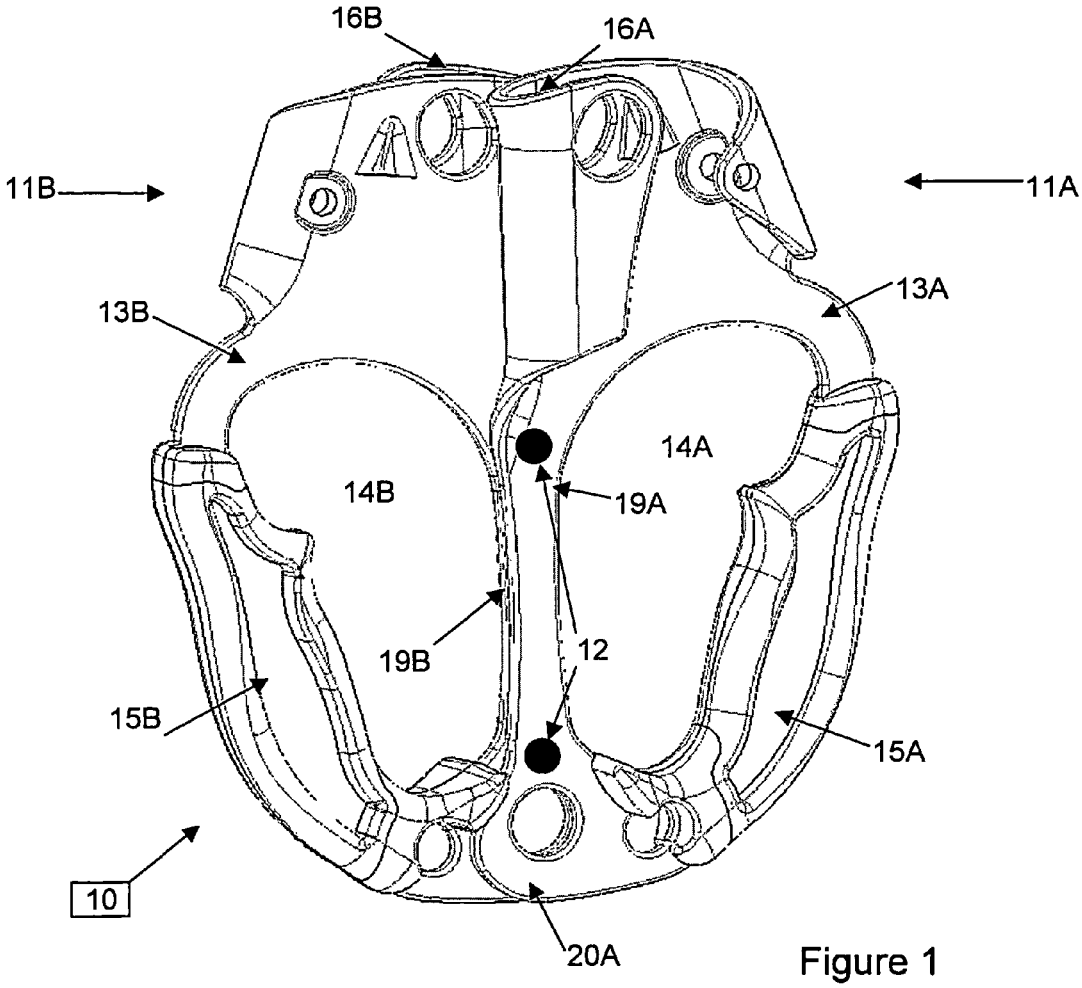
FIG. 1 represents a perspective side view of the flanges of the two adjoined ascenders of the ascender device according to the invention, the jamming cleats not being represented.
Figure 2:
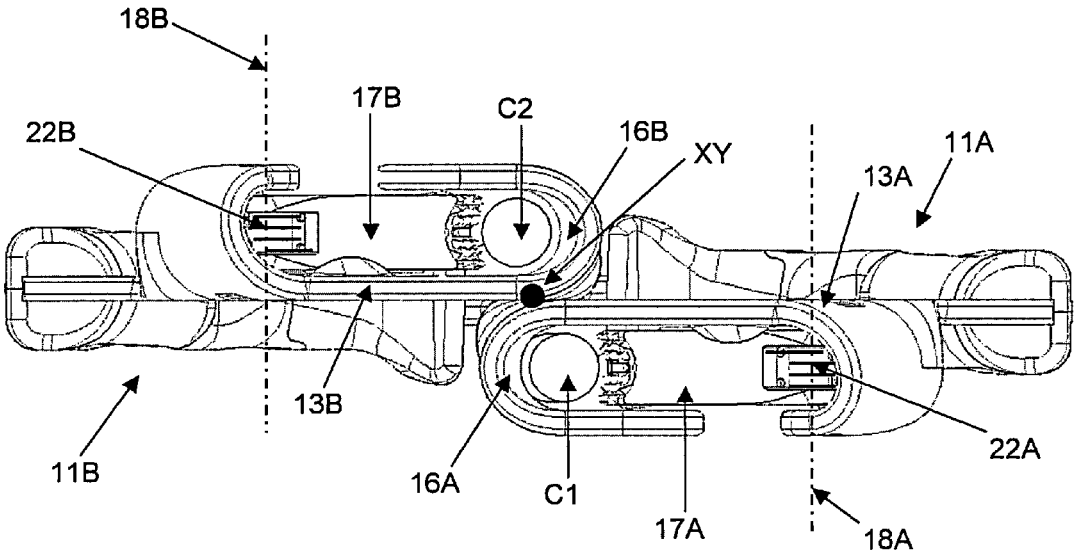
FIG. 2 is a plan view of the ascender device of FIG. 1, with the presence of the two jamming cleats.
Figure 3:
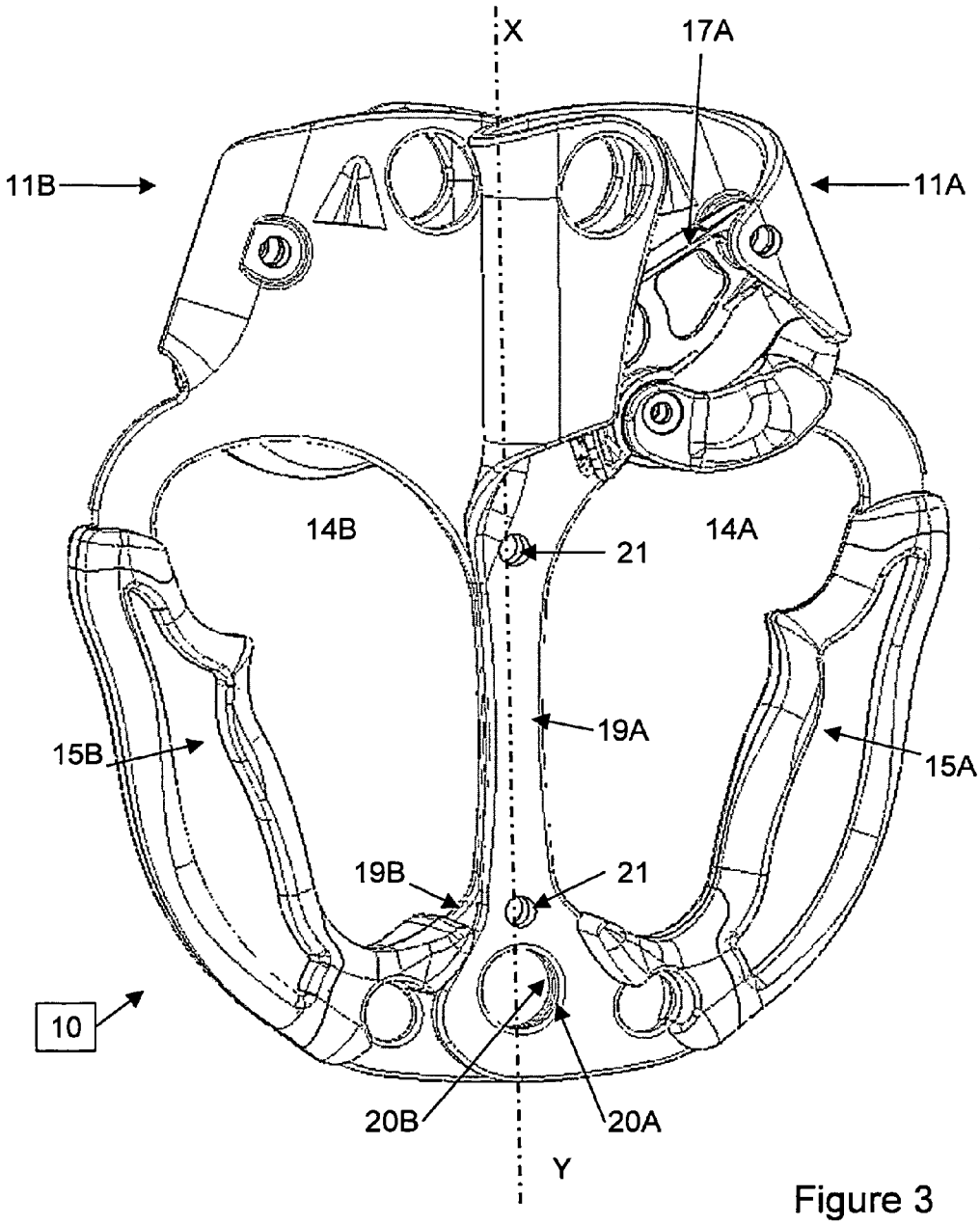
FIG. 3 shows an elevation of the ascender device according to the invention.
Figure 4:
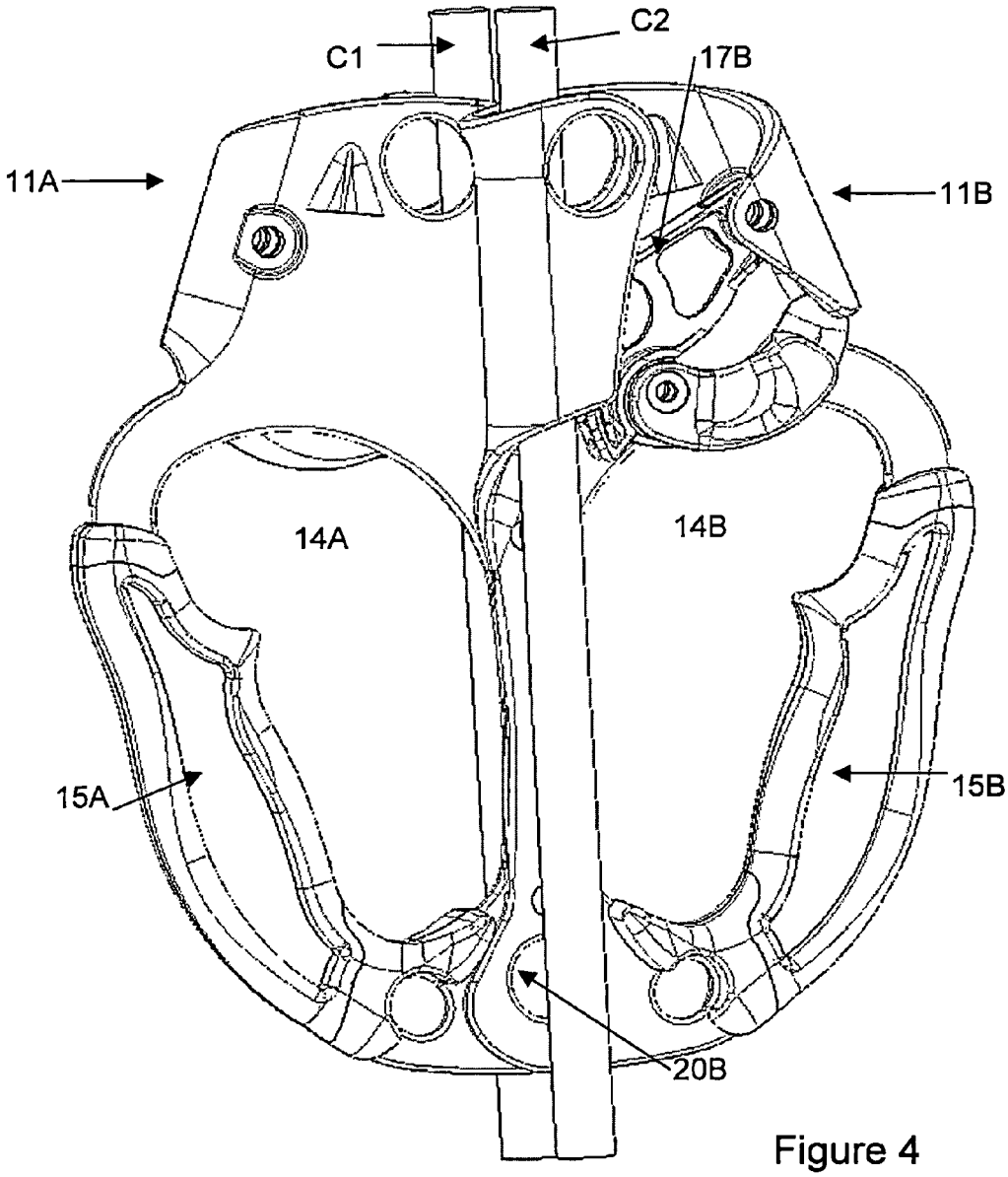
FIG. 4 is an identical view to FIG. 3, after the apparatus has been rotated through 180°.
Figure 5:
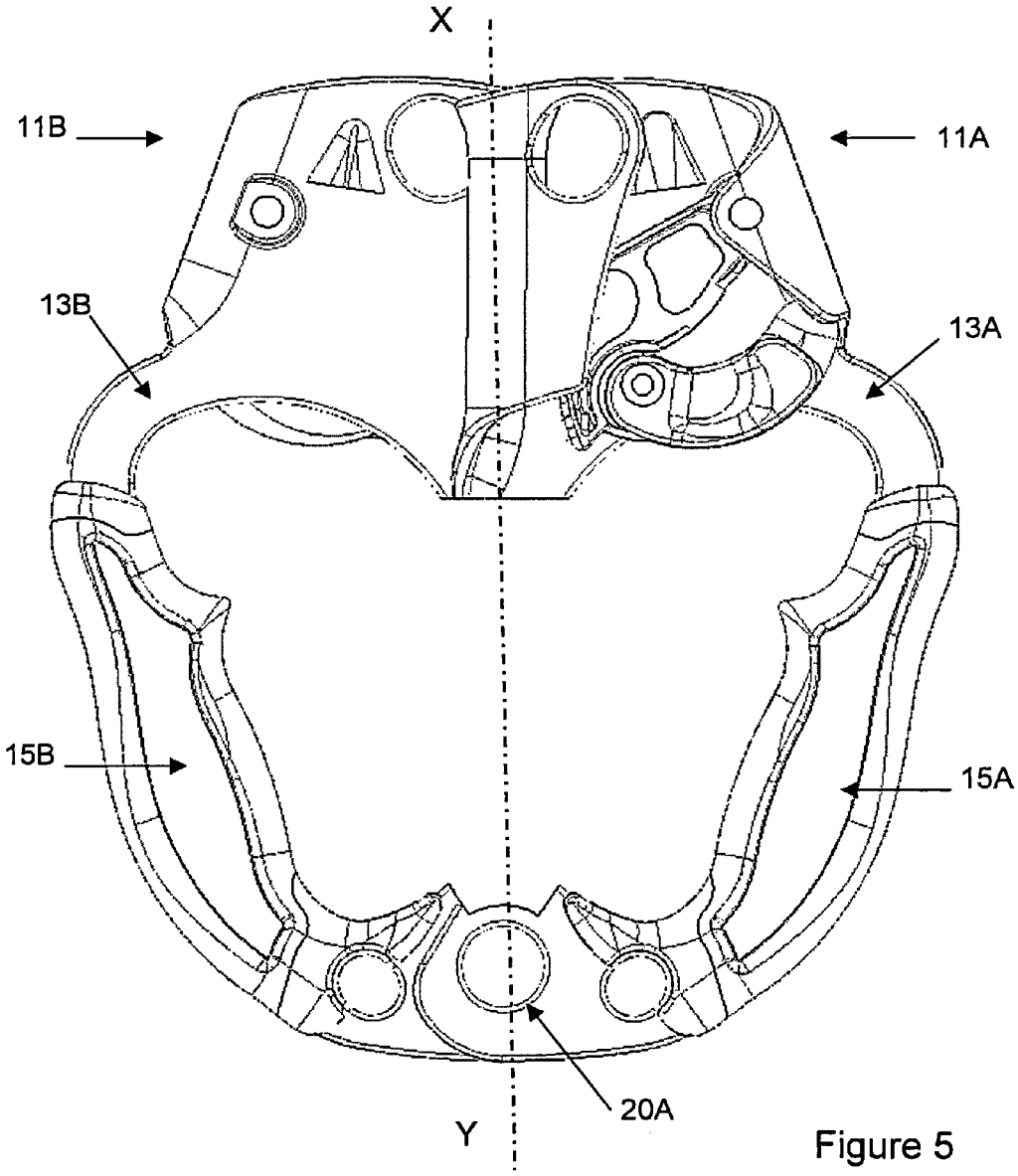
FIGS. 5 and 6 represent two alternative embodiments of the invention.

With reference to the alternative embodiment of FIG. 5, branches 19A, 19B of flanges 13A, 13B are eliminated so as to form a heart-shaped assembly. The mechanical strength of the device can be increased by using a thicker metal plate.

Figure 6:
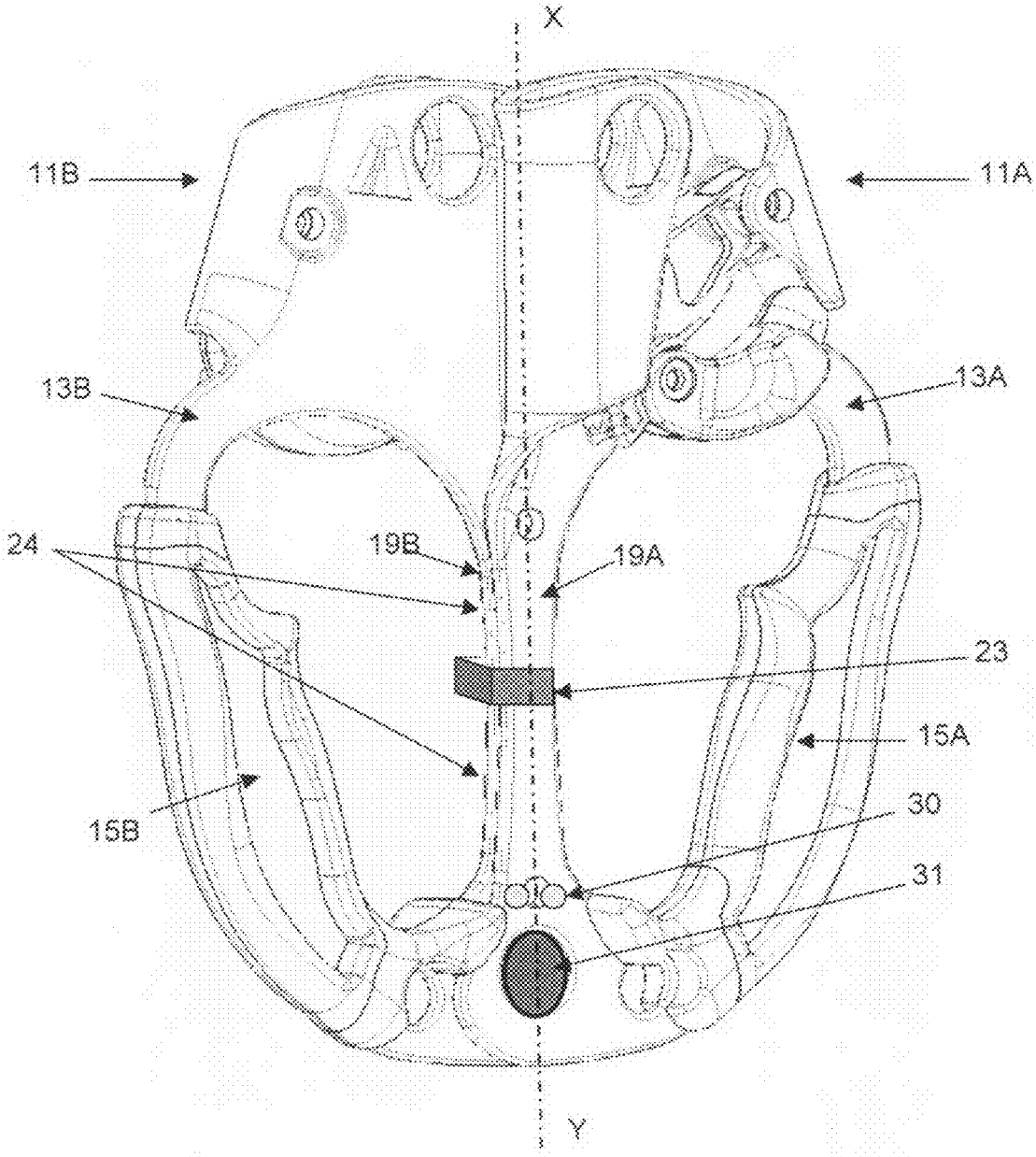

In the alternative embodiment of FIG. 6, branches 19A, 19B of flanges 13A, 13B are securedly attached to one another by means of a crimped ring 23 and rivets 30 or an eyelet 31. A weld 24 can be made along the assembly interfaces of branches 19A, 19B to increase the mechanical strength.

The invention claimed is:

1. An ascender device for ascending on a first rope and a second rope, the ascender device comprising:
- a first ascender; and
- a second ascender assembled to the first ascender by a securing device, each of said first and second ascenders respectively comprising
  - a metal flange, an aperture being cut out at a bottom part of the respective flange forming a flange section for providing a grip on an outside of the respective flange,
  - a trough arranged at a top part of the respective flange for passage of a respective rope of said ropes, and
  - a swivel cleat equipped with a surface for jamming the respective rope in a bottom of said respective trough,
- wherein the flanges are directly joined on an inside by two superposed branches of the flanges and securely attached to one another by the securing device,
- wherein the first and second ascenders are identical and are joined as reversed by being positioned 180° with respect to one another about a vertical axis extending parallel to a major length of the troughs, and the flange sections are symmetrical with respect to the vertical axis so as to be able to be held simultaneously by a user's right hand and left hand, and
- wherein the swivel cleats jam the ropes simultaneously during use.

2. The ascender device according to claim 1, wherein the superposed branches of the flanges are substantially straight extending vertically from the troughs.

3. The ascender device according to claim 1, wherein the vertical axis constitutes an axis of symmetry of the first and second ascenders.

4. The ascender device according to claim 1, wherein the superposed branches comprise holes for passage of the securing device.

5. The ascender device according to claim 4, wherein the securing device is formed by rivets staggered along the vertical axis.

6. The ascender device according to claim 1, wherein the flanges are superposed at a base and comprise a pair of coaxial holes forming a single securing hole for passage of a carabiner.

7. An ascender device for ascending on a first rope and a second rope, the ascender device comprising:
- a first ascender; and
- a second ascender assembled to the first ascender by a securing device, each of said first and second ascenders respectively comprising
  - a metal flange, an aperture being cut out at a bottom part of the respective flange forming a flange section for providing a grip on an outside of the respective flange,
  - a trough arranged at a top part of the respective flange for passage of a respective rope of the ropes, and
  - a swivel cleat equipped with a surface for jamming the respective rope in a bottom of said respective trough,
- wherein the first and second ascenders are identical and joined as reversed by being positioned 180° with respect to one another about a vertical axis extending parallel to a major length of the troughs, and the flange sections are symmetrical with respect to the vertical axis so as to be able to be held simultaneously by a user's right hand and left hand,
- wherein a rope passageway of the trough of the first ascender is spaced from a rope passageway of the trough of the second ascender and the passageways are separated by the metal flange of the first ascender and the metal flange of the second ascender, and
- wherein the swivel cleats jam the ropes simultaneously during use.

* * * * *